US005761761A

United States Patent [19]

An

[11] Patent Number: 5,761,761

[45] Date of Patent: Jun. 9, 1998

[54] TRI-SECTIONED MULTI-PURPOSE GOLF TOWEL

[76] Inventor: Heather An, 3200 Wilshire Blvd., Suite 1310, Los Angeles, Calif. 90010

[21] Appl. No.: 695,586

[22] Filed: Aug. 12, 1996

[51] Int. Cl.[6] ..... A47L 25/00; A63B 57/00

[52] U.S. Cl. ..... 15/209.1; 15/114

[58] Field of Search ..... 15/114, 118, 208, 15/209.1, 210.1

[56] References Cited

U.S. PATENT DOCUMENTS

| | | | |
|---|---|---|---|
| 3,040,357 | 6/1962 | Belleni | 15/209.1 |
| 4,224,712 | 9/1980 | Black et al. | 15/209.1 |
| 4,403,366 | 9/1983 | Lucke | 15/209.1 |
| 4,771,502 | 9/1988 | Trimble | 15/209.1 |
| 5,075,918 | 12/1991 | Zeltner et al. | 15/208 X |
| 5,147,703 | 9/1992 | Provost et al. | 15/209.1 X |
| 5,394,914 | 3/1995 | Meek | 15/209.1 X |

*Primary Examiner*—Mark Spisich
*Attorney, Agent, or Firm*—Eugene Oak, Ph.D. J. D.

[57] ABSTRACT

A tri-sectioned multi-purposed golf towel comprising two side of fabric, one side preferably being made of an absorbent material such as terry cloth, and the other side made of a more coarse material, wherein the rectangular towel is divided into three longitudinal sections of equal width, first, second and third longitudinal sections. The first longitudinal section is folded over the second longitudinal section, and then the third longitudinal section is folded over the first longitudinal section. The ends of the towel are secured by binding strips to prevent fraying of the towel. The upper end of the trifolded towel is then stitched transversely. Adjacent to the permanently bound end, preferably centrally disposed on one of the outer faces of the towel, is a circular looping patch which corresponds to a circular hooking patch which is located on the outer face of the towel as well. A hooking member with a hooking patch which corresponds to the looped patch of the towel allows the towel to be hung in various places.

8 Claims, 4 Drawing Sheets

TRI-SECTIONED MULTI-PURPOSE GOLF TOWEL

BACKGROUND OF THE INVENTION

1. Field of the Invention

The present invention relates generally to the sport of golf, specifically to towels and clothes used in the sport of golf for various applications.

2. Description of the Prior Art

While on the golf course, there are numerous occasions when a golfer may employ some type of rag or cloth to wipe off perspiration, or to remove dirt from the golf equipment, ball, or bag. Such a rag or cloth has generally been in the form of some type of towel which may either be stuffed into the golf bag, or provided with some type of hanging means, such as a hook or loop which can be attached to the golf bag or the golfer in some appropriate manner. Golf towels which have been heretofore provided are bulky and not easily handled or conveniently carried. Problems also arise in connection with the manner in which they are hung and the manner in which they are washed. These problems are due to the fact that golf towels heretofore available are little more than terry cloth rags provided with some type of hanger at one end.

Therefore there is a need for an attractive personalized towel fabricated at a reasonable expense, and yet is well secured against fraying and adapted not only for hanging, but useable for cleaning golf equipment, for wiping perspiration, and for scrubbing mud and dirt from the ball, clubs, bags and other equipment, yet lending itself to convenient washing.

SUMMARY OF THE INVENTION

The present invention is a towel which is formed with its inner side presenting a terry cloth face and its outer side featuring a less absorbent fabric surface. The rectangular towel is divided into three longitudinal sections of equal width, a first longitudinal section, a second longitudinal section, and a third longitudinal section. The first longitudinal section is folded over the second longitudinal section to place the terry cloth faces of the two sections in abutment; the third longitudinal section is then folded over the outer face of the first longitudinal section. Both ends of the towel may be secured by a binding strip. When the first and third longitudinal sections are folder over in the manner described, the ends of the three sections will be in substantial register, and one of such registering ends is permanently secured together, such as by traverse stitching or other means.

Adjacent to the permanent bound end, preferably centrally disposed on one of the outer faces of the towel, a VELCRO™ looping patch is secured to receive a corresponding patch of VELCRO™ hooking patch. Such a hooking patch is then provided on and near the opposite end of the same face of the section of the towel, which section end is not secured to the ends of the other sections of the towel. Therefore, when the towel is folded about a transverse bisector of the three sections, the opposite ends of the patched face of the towel may be removably secured together by bringing the hooked patch into facing engagement with the looped patch. Such an engagement is desirable when the towel is being washed in order to prevent thread, lint and other particles which may be entrained in the washing fluid from adhering to either of the VELCRO™ patches.

The VELCRO™ looped patch adjacent to the bound end of the towel, however, performs a second function, namely, to receive and support a towel hanging element. This may be in the form of a washable leather or plastic disk, or of such other configuration as may conform with the looped patch, with its back face having VELCRO™ hooks. This disk may have a projecting tab which extends beyond the perimeter of the looped patch so as to not be held down by the same. This projection may be orificed and provided with a grommet in the orifice through which may be passed some type of hook or chain which can serve as a means for hanging the towel on the golf bag, golf cart, or the golfer's belt. The outer face of the disk may be monogramed.

Desirably, the looped patch may be stitched to the outside face of the towel which passes through both the center section and the first folded section of the towel. Provision may also be made for the permanent attachment of a washable leather or plastic medallion on the opposite face of the towel from that having the looping patch.

In use, the hanging disk may be initially attached to the looping patch by pressing the VELCRO™ hooking on the back face of the disk against the looped patch. Thereby, the towel may be hung on the back of the golfer's bag, or elsewhere as desired.

It will be found that the hooked patch at the opposite end of the towel may also serve as means to enable the golfer to scrub dirt or mud off a ball, a club or the golf bag, with further cleaning being accomplished by simply rubbing the object beyond the hooked patch and over the adjacent fabric.

When the towel becomes soiled and is ready for washing, the hooked hanging disk may be pulled off the looped patch on the outer face of the upper secured end of the towel, and the towel is folded to place the hooked patch at the opposite end of the towel in abutment with the looped patch. If, as recommended, the golfer carries a plurality of towels in his bag, he may take a clean towel, and, if folded and held together by VELCRO™ patches, open up the towel and place the hooked hanging disk on the looped patch of the clean towel to enable the latter to be hung as desired.

It is therefore evident that the golf towel of the present invention offers a number of advantages over towels previously available to golfers.

BRIEF DESCRIPTION OF THE DRAWINGS

The following brief description of the drawings which accompany the specification should be taken in connection with the following Detailed Description. The following are included in the drawings.

Figure 1:
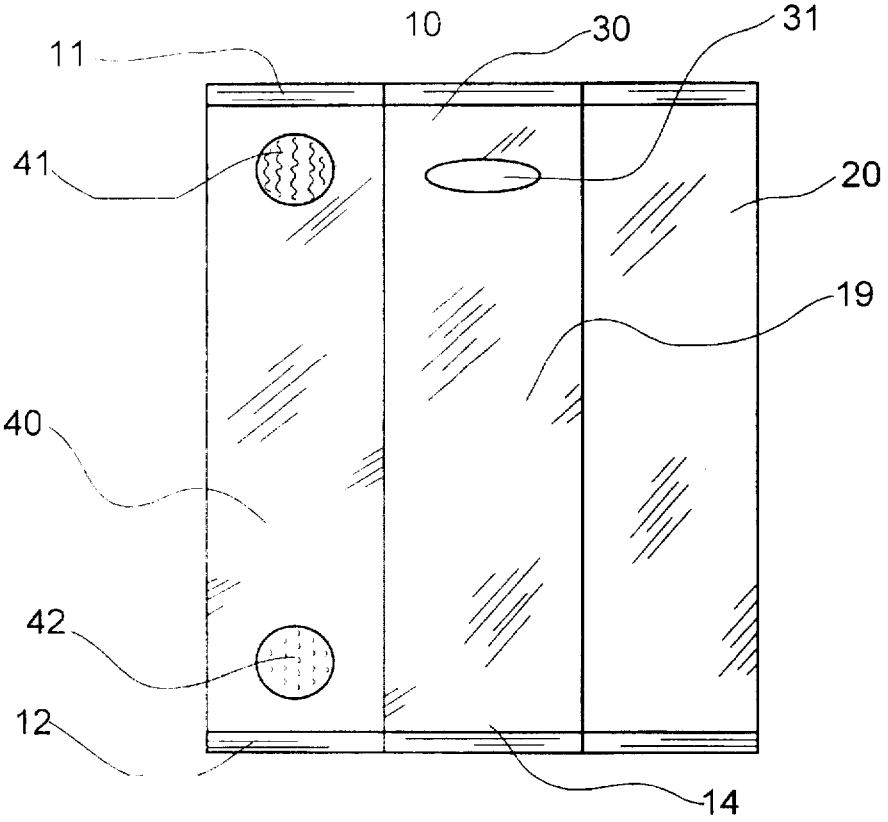
FIG. 1 is a perspective view of the outer side of the towel employed for the invention.

REFERENCES CITED IN THE DRAWINGS AND THE DETAILED DESCRIPTION OF THE PREFERRED EMBODIMENT

The following is a list of references cited in the drawings and the detailed description of the preferred embodiment. The references are:

10 is a rectangular towel.

11 is an upper end of said rectangular towel.

12 is a lower end of said rectangular towel.

13 is an upper binding strip.

14 is a lower binding strip.

15 is transverse stitching across said upper end of said towel.

16 is circular stitching.

18 is an inner side of said rectangular towel.

19 is an outer side of said rectangular towel.

20 is a first longitudinal section of said towel.

30 is a second longitudinal section of said towel.

31 is a leather patch.

40 is a third longitudinal section of said towel.

41 is an upper circular looped patch.

42 is a lower circular hooking patch.

50 is a hooking member.

51 is a hooking patch of said hooking member.

52 is a tab of said hooking member.

53 is an orifice of said tab of said hooking member.

54 is a chain which is accommodated by said orifice.

DETAILED DESCRIPTION OF THE PREFERRED EMBODIMENT

Figure 2:
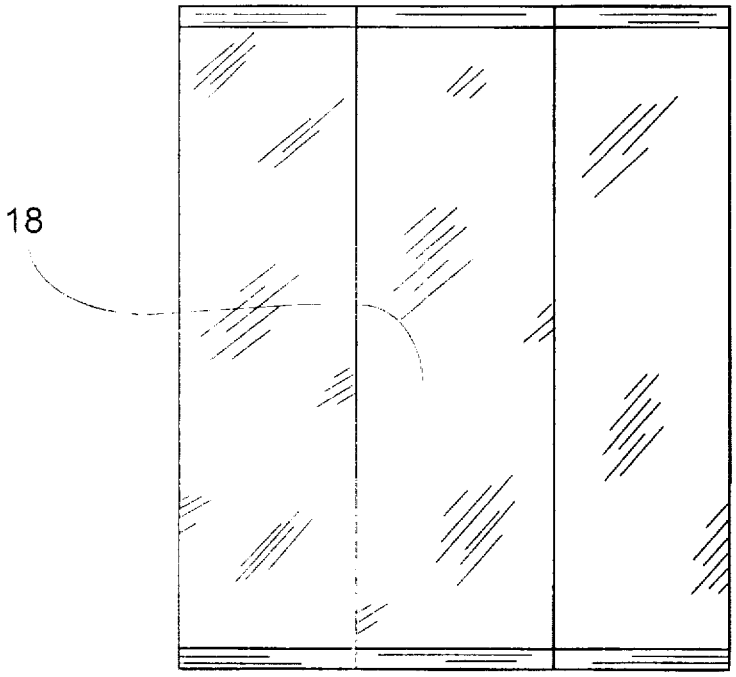
FIG. 2 is a perspective view of the inner side of the towel employed for the invention.
Figure 3:
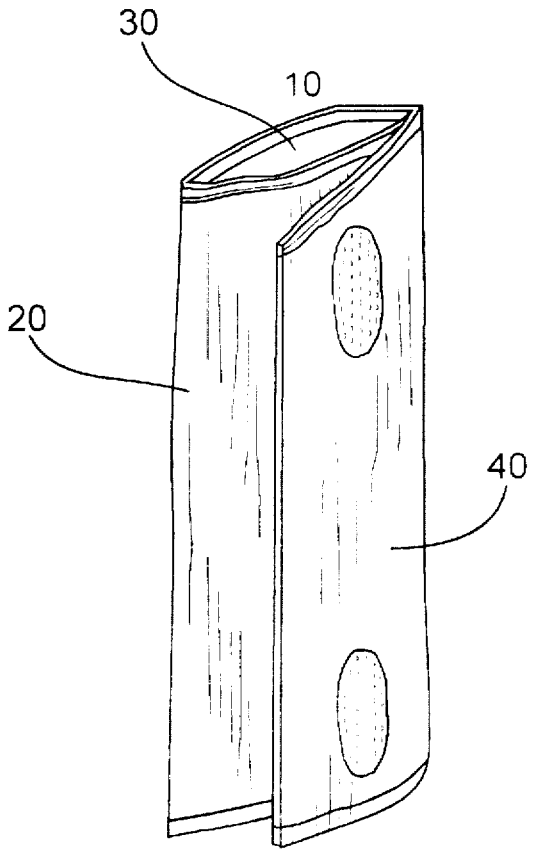
FIG. 3 is a perspective view depicting the manner in which the towel is folded before its section ends are secured.
Figure 4:
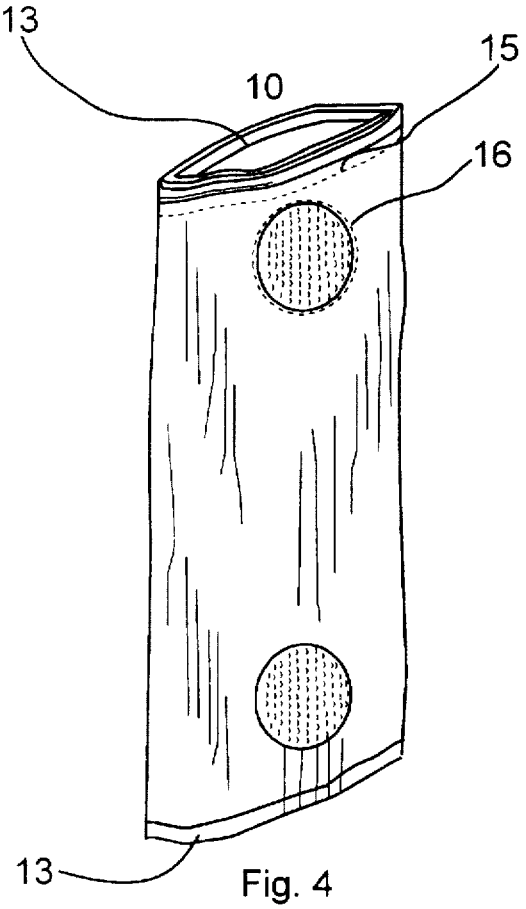
FIG. 4 is a perspective view of the towel after its three sections have been completely folded and one end of each section has been stitched together.
Figure 9:
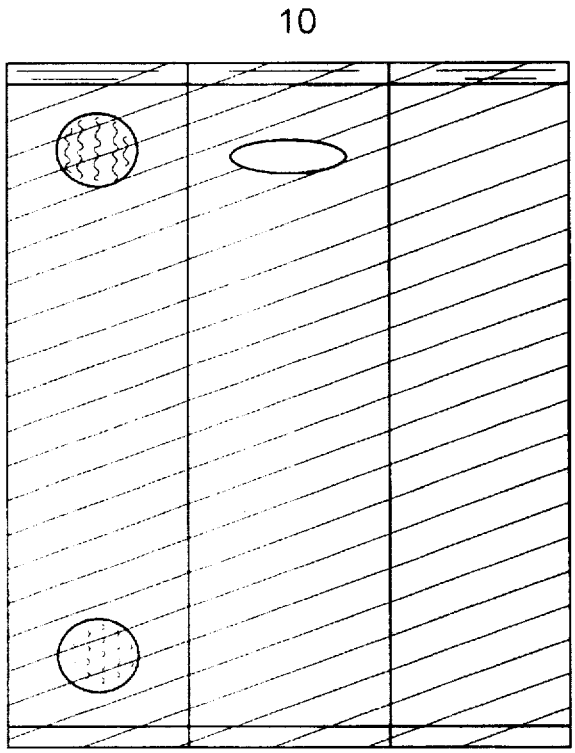
FIG. 9 is a perspective view of a towel as disclosed in previous figures wherein a dress covering has been applied to the outer side of the towel.

A towel 10 fabricated in accordance with the present invention is illustrated in FIG. 4 and is formed in the manner portrayed in FIG. 1, FIG. 2, and FIG. 3. A rectangular towel 10 comprises two sides of fabric, the inner side being made of terry cloth or another moisture absorbing material, and the outer side being made of either terry cloth, a coarse fabric to facilitate scrubbing, or a decorative fabric as depicted in FIG. 9. The aforementioned rectangular towel 10 is preferably secured against fraying at both its upper end 11 and the lower end 12, by the upper binding strip 13 and lower binding strip 14, respectively.

Referring to FIG. 1, FIG. 2, and FIG. 3, to form the towel 10 in accordance with the present invention, it should be regarded as divided into three longitudinal sections, a first longitudinal section 20, a second longitudinal section 30, and a third longitudinal section 40. The first longitudinal section 20 is first folded to cover the second longitudinal section 30 and then the third longitudinal section 40 is folded to cover the folded first longitudinal section 20. Referring to FIG. 4, all three sections 20, 30 and 40 are thus adjacently oriented on top of each other, and the upper end 11 is permanently secured together by transverse stitching 15.

Referring back to FIG. 1, the third longitudinal section 40 is provided with an upper circular looped patch 41 of VELCRO™, and a corresponding lower hooking patch 42. These patches 41 and 42 are securely affixed to the third longitudinal section 40, preferably by stitching, with a further circular stitch 16 running through all three sections 20, 30, and 40 after they have been secured together as stated above in reference to FIG. 4. A trademark or manufacturer's name may be applied to the towel by means of stitching a washable leather patch with the trademark or manufacturer's name 31 to the upper area of the center section 30.

Figure 5:
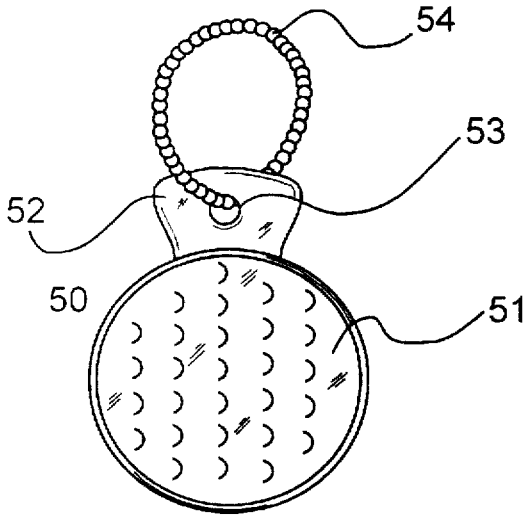
FIG. 5 depicts the hanging member which is used in to hang the present invention.
Figure 6:
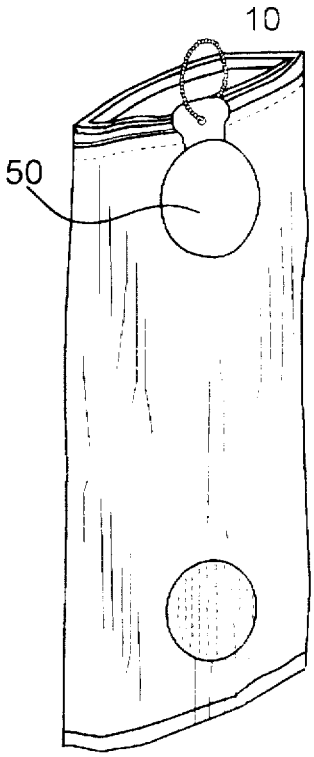
FIG. 6 depicts the folded towel with the hanging member attached.

Referring to FIG. 5, in order that the towel 10 may be conveniently hung from one end, a hanging member 50 is provided which corresponds to the upper circular looped patch 41 of VELCRO™. One face of the hanging member 50 has a VELCROTM hooking patch 51, and the hanging member 50 also has a tab 52 having an orifice 53 to enable a chain 54 to be passed through the orifice 53. This hanging member 50 serves as a means for hanging the towel 10 after the hanging member 50 has been placed against the upper looped patch 41 where it is removably held in attachment with the same. The other side of the hanging member 50 may be monogramed, or other decorative designs may also be printed or stitched. FIG. 6 depicts the hanging member 50 attached to the towel 10.

Figure 7:
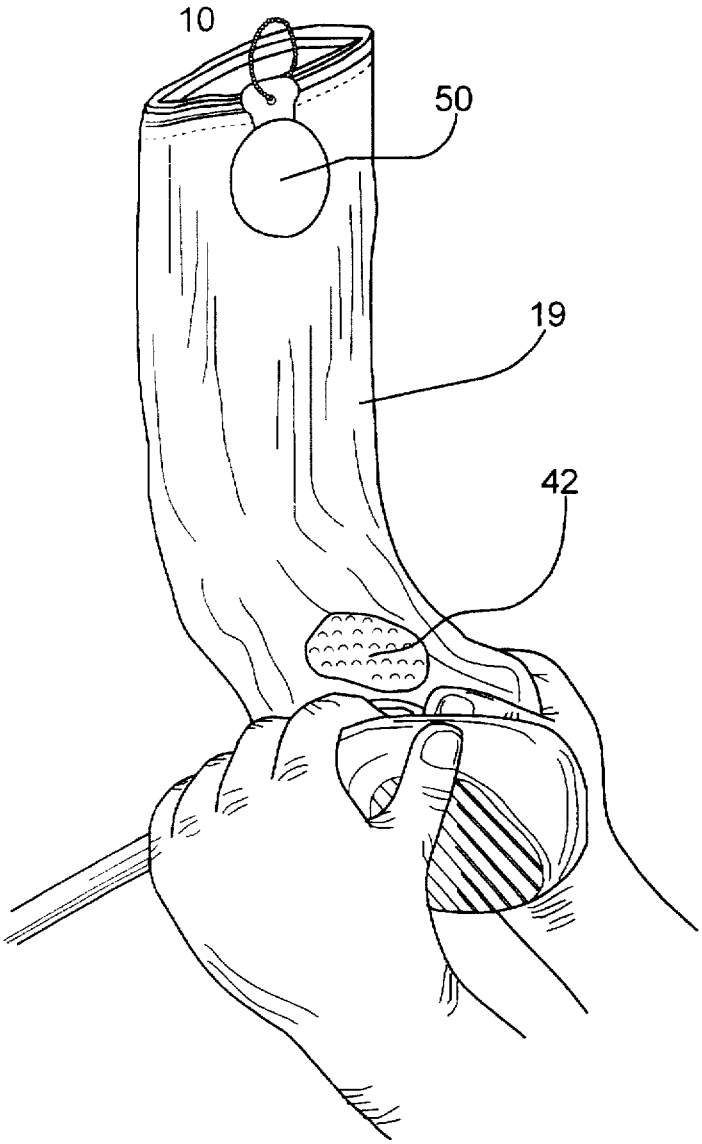
FIG. 7 illustrates the manner in which the hooking patch may be used to scrub a golf club.

Referring to FIG. 1 and FIG. 2, when the present invention is in use, the inner surface 18 of the folded towel 10 serves the usual function of a towel 10, e.g. to wipe perspiration from the golfer's hands or face. The outer surface 19 may also be used to wipe perspiration or wipe golf equipment, depending on the fabric. Referring to FIG. 7, the lower hooking patch 42 of the towel 10 may function as a scrubber to remove dirt, grass and other undesired matter from a golf ball or golf club, or perhaps even a golf bag.

Figure 8:
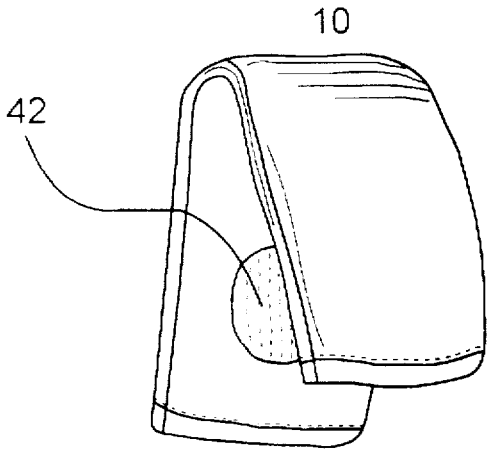
FIG. 8 illustrates the manner in which the towel may be folded after use.

When it is no longer desired to keep the towel 10 hung on the golfer's belt, bag, or cart, the hanging member 50 is pulled away from the upper circular looped patch 41 and the towel 10 is then folded in half and the upper looped patch 41 is matably engaged with the lower hooking patch 42 to secure the towel 10 as shown in FIG. 8. Not only does this result in enabling the towel 10 to be further rolled up and conveniently carried in a pocket, in a golf bag or a jacket, but, when the towel 10 is washed, the present arrangement prevents thread and lint from attaching to the lower hooking patch 42.

From the foregoing description with reference to the drawings, it will be appreciated that the towel of the present invention offers several advantages over towels heretofore available to golfers.

What is claimed as being new and therefore desired to be protected by Letter Patent of the United States is as follows:

1. A tri-sectioned multi-purpose golf towel comprising a towel, wherein said towel has two sides, an inner side and an outer side, said innerside presenting an absorbent fabric, and said outer side presenting a more coarse fabric;

a) said towel having two ends, an upper end and a lower end, wherein said upper end has a corresponding upper binding strip to prevent fraying of said towel, wherein said lower end has a corresponding lower binding strip to prevent fraying of said towel;

b) said towel longitudinally divided into three equal sections, forming a first longitudinal section, a second longitudinal section, and a third longitudinal section, wherein said second longitudinal section is between said first longitudinal section and said third longitudinal section;

c) said first longitudinal section folded inwards and adjoining said second longitudinal section, and said third longitudinal section folded inwards and adjoining said folded first longitudinal section, thereby forming a tri-folded towel;

d) said tri-folded towel transversely stitched at said upper end;

e) said outer side of said third longitudinal section of said tri-folded towel having an upper circular looped patch at said upper end, and a lower circular hooking patch at said lower end, wherein said upper circular looped patch and said lower circular hooking patch may be removably affixed to each other; and f) said upper circular looped patch forming a matable engagement with a hooking member, wherein said hooking member comprises a hooking patch which fastens to and corresponds with said upper circular looped, patch, a tab which has an orifice which accommodates a chain which allows said tri-folded towel to be hung.

2. A tri-sectioned, multi-purpose golf towel as mentioned in claim 1, wherein said outer side of said towel is made of a decorative fabric.

3. A tri-sectioned, multi-purpose golf towel as mentioned in claims 1 or 2, wherein said outer side of said towel is embroidered.

4. A tri-sectioned, multi-purpose golf towel as mentioned in claims 1 or 2, wherein said upper end of said outer side of said second longitudinal section has a washable leather patch, wherein said washable leather patch is monogramed.

5. A tri-sectioned, multi-purpose golf towel as mentioned in claims 1 or 2, wherein said lower end of said tri-folded towel is stitched together.

6. A tri-sectioned, multi-purpose golf towel as mentioned in claim 3, wherein said upper end of said outer side of said second longitudinal section has a washable leather patch, wherein said washable leather patch is monogramed.

7. A tri-sectioned, multi-purpose golf towel as mentioned in claim 3, wherein said lower end of said tri-folded towel is stitched together.

8. A tri-sectioned, multi-purpose golf towel as mentioned in claim 4, wherein said lower end of said tri-folded towel is stitched together.

* * * * *